US006325297B1

(12) United States Patent
Calvin et al.

(10) Patent No.: US 6,325,297 B1
(45) Date of Patent: Dec. 4, 2001

(54) ATMOSPHERIC LIQUID HEATER

(76) Inventors: Donald R. Calvin, 29490 S. 369$^{th}$ West Ave.; Thomas B. Calvin, 21640 S. 417$^{th}$ Ave., both of Bristow, OK (US) 74010

( * ) Notice: Subject to any disclaimer, the term of this patent is extended or adjusted under 35 U.S.C. 154(b) by 0 days.

(21) Appl. No.: 09/461,455

(22) Filed: Dec. 14, 1999

Related U.S. Application Data

(63) Continuation-in-part of application No. 09/106,911, filed on Jun. 29, 1998.

(51) Int. Cl.$^{7}$ ..... B60H 1/02
(52) U.S. Cl. ..... 237/12.3 B; 237/69
(58) Field of Search ..... 237/69, 66, 56, 237/12.3 B

(56) References Cited

U.S. PATENT DOCUMENTS 3,568,924 * 3/1971 Chenault ..... 237/69
4,646,818 * 3/1987 Ervin, Jr. ..... 165/703
4,986,311 * 1/1991 Mikkelson ..... 138/35
5,181,655 * 1/1993 Bruckelmyer ..... 237/1 R
5,244,037 * 9/1993 Warnke ..... 165/104.31
5,707,007 * 1/1998 Fiedrich ..... 237/8 R

* cited by examiner

*Primary Examiner*—Harold Joyce
*Assistant Examiner*—Derek S. Boles
(74) *Attorney, Agent, or Firm*—Rader, Fishman & Grauer PLLC; Lee G. Meyer

(57) ABSTRACT

A mobile heating system for providing hot liquids is provided. The system includes a trailer mounted liquid boiler, an exit manifold for distribution through hoses, a return system communicating with a return manifold in communication with a reservoir for storing heated liquid and a bypass valved shunt such that by providing incremental heat through the liquid boiler back to the reservoir via the bypass valved shunt and then back to the boiler through the exit manifold and back to the reservoir by means of the return manifold, sufficient energy is maintained to allow atmospheric 205+ degree liquid to be circulated within the system. In one aspect of the system, by means of contact with the hot hoses, a substance is used for thawing ground, heat, melting snow and ice, curing cement, and the like. In another aspect, the liquid is water used to provide for example, hygienic liquid or hot water for field showers. In a further aspect, the apparatus can be hooked into the hose line to provide radiated heat for convection into space, such as in construction of a building, a house and the like.

56 Claims, 4 Drawing Sheets

ATMOSPHERIC LIQUID HEATER

The present application is a Continuation-in-Part of application Ser. No. 09/106,911 filed Jun. 29, 1998, for an Atmospheric Liquid Heater. The parent application, which is incorporated by reference in its entirety, discloses a portable atmospheric heater for recirculating super-heated aqueous solutions and a method for using same.

BACKGROUND OF THE INVENTION

1. Field of Invention

This invention relates to atmospheric liquid heaters; and, more particularly, to portable atmospheric heaters having improved startup, shutdown and recirculating performance for more efficiently providing super-heated aqueous solutions.

2. Description of Related Art

In cooler climes, such as the northern and southern regions of the globe, as well as at high altitude, such as in the Rocky Mountain areas, portable heating devices are often needed. Although there are many portable heaters in many aspects, these heating systems suffer from one or more problems which render them deficient in supplying the quality and quantity of heated liquid required. While a number of pressurized boilers for providing heated steam/water mixtures exist, they are somewhat complicated, require pressurized vessels, and are expensive to build and maintain. Additionally, housing pressurized vessels, pump valves, and the like become somewhat difficult if the system needs to be mobilized, especially in mountainous areas with inferior roads and limited access to the specific areas in which the systems are to be utilized.

One of the problems with most atmospheric boilers is that, as the altitude increases, the temperature at which the liquid boils decreases. Thus, in order to achieve elevated liquid temperatures at atmospheric pressure, it is frequently necessary to employ boiling point elevators to increase the liquid temperature at which the liquid boils. These substances can cause corrosion as well as limit the use of the boiler system. For example, heated pure water is necessary for field showers and the like, but, in such cases, boiling point enhancers may be toxic and, therefore, cannot be used.

Additionally, at high altitude or in northern climates, melting snow or thawing the ground is required, for example, to dig trenches or foundations, lay wire, pipe-cure concrete, and the like during the winter months. Further, in these climes, a portable heating device is necessary to remove ice and snow from, for example, shelters and sheds nestled in mountainous terrain. Finally, portable heating devices are needed for the construction of buildings, houses, and the like in remote, inclement locations, so that workmen can enjoy a conducive work environment free from the mobility constraints imposed by the need for multi-layered clothing.

Heretofore, a number of devices have been available to do one or more of the aforementioned tasks, but none have been versatile enough to meet all of the above needs adequately. For example, U.S. Pat. No. 5,181,655, for a "Mobile Heating System" issued to Mark Bruckelmyer on Jan. 26, 1993, provides for a mobile heating system used to thaw the ground in preparation for construction. The disclosed heating system involves pumping heated water from a reservoir through hosing to a plurality of elongated boiler probes which are driven into the ground, or whatever substance needs to be thawed. Generally, this patent discloses a heating system for thawing frozen ground or building materials, such as bricks. The invention includes a boiler for heating fluid which is circulated by a pump through a connected line which is in fluid communication with a plurality of elongated heater probes adapted to be implanted in the ground. An antifreeze reservoir is connected to the line for pumping antifreeze into the line to protect it and the probe from freeze-damage when not in use. This system has a number of draw-backs, including the necessity of driving the heating probes into the frozen earth.

Likewise, U.S. Pat. No. 5,567,085, for "A Method of Thawing Frozen Ground for Laying Concrete" issued to Bruckelmyer on Oct. 22, 1996, uses a circulation hose that is covered with an aggregate and placed into a form from which concrete is poured. In one embodiment, the hot fluid circulating within the aggregate-covered hose becomes a part of the concrete structure, and the hose is severed at its exit point from the concrete forms. The disclosed method involves placing a continuous length of circulating hose on the frozen ground, either inside or adjacent to the concrete form where the concrete is to be poured, and then covering the hose with a layer of aggregate material for insulation. In one aspect, this method invention is for circulating warm liquid through a circulating hose inserted into poured concrete to prevent freezing while the concrete hardens. A disclosed advantage is that this method of thawing frozen ground to lay concrete does not require removal of the hose prior to actually laying the concrete.

Neither of these systems employ a booster recirculating-type reservoir system to provide high heat gain, fast recovery and high heat capacity for incrementally super-heating the aqueous liquid before it is returned to the system. In addition, these systems are not designed for high-capacity water needs, such as providing hot water for field showers or for other hygienic purposes, such as forestry services, and the like. Thus, it would be advantageous to have a high-capacity, atmospheric, transportable system to provide hot water and heat to remote and undeveloped sites, such as locations that are under construction or in developmental stages, whether the need was for space heating, drying and curing concrete, plaster, or paste, or the like, or for simply melting ice and snow and thawing earth in preparation for forms, or for laying wire, conduit pipe, and the like.

U.S. Pat. No. 4,491,113, for a "Probe for Circulating Heated Water" issued to Mark Bruckelmyer on Sep. 12, 1995, generally discloses an insertable thawing probe as a portion of a mobile heating system which circulates heated water and thaws frozen ground. The probe includes a T-connection having both a fluid inlet section and a fluid outlet section. The probe is generally used for insertion into frozen ground for thawing areas proximate to frozen sewer or water lines.

In very cold climates, bringing the temperature of the circulating fluid up to the required temperature is time consuming and requires substantial amounts of energy. The systems that provide for the circulation of heated liquids throughout the thawing circuit described above require the entire body of liquid to return to the boiler to be heated.

It would be advantageous to have a high heat capacity, atmospheric heating system wherein the liquid could be brought to temperature without use of hose shunts or the like. In accordance with the heater disclosed in my prior application, which, as stated above, is incorporated by reference herein in its entirety, two short lines were used to connect the exit and return manifolds to preheat the system by circulating the fluid through the entire system. It would therefore be advantageous to have a liquid heater with a preheating circuit which bypasses the entire system during idle or startup. It would also be advantageous to have a flushing system which clears out the lines without requiring the user to handle a wet flushing tool.

SUMMARY OF THE INVENTION

It has now been discovered that a valved shunting system, which allows aqueous liquid heated in the boiler to be routed through the liquid reservoir and returned directly to the boiler without circulating through the remainder of the mobile atmospheric heating unit, improves liquid heating rates for startup and idling of the device, conserves energy, greatly improves efficiency, reduces pumping and electrical requirements, and allows improved layout configurations for the liquid heater of the instant invention. Additionally, a dual launching/catching pigging system allows faster and more efficient de-liquification of the conduits and/or hoses which carry the aqueous liquid.

In the broad aspect, an improved mobile atmospheric unit for heating liquid, preferably an aqueous liquid, comprises a high heat capacity liquid heater or boiler; an exit manifold; at least one conduit communicating with the exit manifold and the boiler for circulating the hot liquid; a return manifold, which communicates via at least one hose with the exit manifold for returning the hot liquid; a liquid reservoir which stores liquid returning from the return manifold and which communicates via conduits with both the return manifold and the high heat capacity liquid boiler such that the returned liquid is retained in the reservoir prior to being returned to the boiler; a pump communicating via conduits with both the liquid reservoir and the boiler for returning liquid from the reservoir to the boiler; and, a valved shunt system communicating between the boiler and the reservoir for bypassing the exit manifold and allowing the heated fluid to flow from the boiler directly to the reservoir. When the shunt is activated, the stored liquid flows from the liquid reservoir through the pump and back into the boiler for continued heating to effect a faster and more energy efficient warm up period and/or a low energy consumption idle or standby mode.

In accordance with the instant invention, a valved shunt communicates with the boiler and with the reservoir such that a bypass route is provided to allow liquid to flow directly from the boiler to the reservoir and back through the pump and into the boiler for a quick warm up cycle, as well as to allow stand-by for maintenance without circulating liquid throughout the entire system. In a preferred embodiment, a bypass-valved shunt contains a dual positioned check valve such that when the bypass-valved shunt is in a first position, heated liquid flows from the boiler directly to the reservoir but is substantially precluded from flowing into the system. When the dual positioned check valve is in a second position, the liquid flows from the boiler through the remaining system but is substantially precluded from flowing directly into the reservoir. In another embodiment, the bypass-valved shunt has a single positioned valve and a second valve is incorporated between the boiler and the exit manifold. When the bypass-valved shunt valve is open, the second valve located between the boiler and the exit manifold preferably is partially or fully closed. The liquid can then flow from the boiler directly to the reservoir. When the bypass valved shunt valve is closed, and the second valve located between the boiler and the exit manifold is open, the liquid can flow through the entire system.

In accordance with one preferred aspect, component relocation and trailer changes are facilitated by use of the bypass valved shunt allowing relocation of the exit and return manifolds to maximize space utilization and shorten hose lengths on the trailer to affect a more efficient floor layout. For example, the improved design provides for fewer hoses crossing the floor of the trailer, more flexibility of placement of unit components, a safer working environment, and more accessability of components for maintenance.

In accordance with the invention, the liquid reservoir incrementally feeds the liquid to the high heat capacity liquid boiler. The liquid is then heated to between 165 degrees to 200 degrees Fahrenheit. The device permits various appliances to be added, such as metal conduits, radiators, and additional hoses by merely splicing into the pre-existing hose lines.

Thus, the improved device of the instant invention permits pre-heating of the liquid without running the fluid through the entire system. Additionally, the unit can be idled while hoses are moved, new hoses attached to the manifolds, and the like, while maintaining the temperature of the heated liquid. By utilizing the bypass valved shunt, the user can route the liquid to flow directly from the boiler to the liquid reservoir and back through a pump into the boiler for a quick warm up cycle or to accomplish stand-by.

In accordance with another aspect of the instant invention, the conduit or hose used to deliver the hot liquid to the work site can be more easily and efficiently cleared of liquid via a dual fluid removal system so that one, two or, three lines can be independently shut down or can be pumped out and emptied at the time of relocation or transport of the trailer.

Accordingly, a dual fluid removal system is provided and operates by means of dual launcher/catcher for pigging devices located preferably on opposite ends of the conduit. Thus, a pigging device which is launched through the system by means of a first launcher/receiver pig catcher is then received by a second launcher/receiver pig catcher. When the conduit is to be cleared of liquid again, the first and second launcher/receiver pig catcher reverse roles. Thus, the second launcher/receiver pig catcher launches the pigging device while the first launcher/receiver pig catcher receives the pigging device. This eliminates the constant need to get the user's hands and gloves wet by handling the pigging device and allows for lighter, more flexible, and more maneuverable lines for lifting, re-distribution, or take-up. For better identification of which hose(s) is(are) in use, being "pigged", leaking, entangled or the like, the hoses of the instant invention preferably are color coded.

The voltage system in the instant invention comprises a 120 volt, three wire system, which allows power from a common 15–20 amp receptacle to be used instead of requiring a trailer mounted generator. This improvement allows for the device to operate from a three-wire heavy duty extension cord as well as a standard 120 volt generator. The voltage system is more economical due to the reduced wattage requirements as well as the elimination of the generator.

The improved liquid heater of the instant invention, employing modern technology heating systems, provides for better fuel consumption, an increase in temperature capacity, the ability to tailor the boiler and its capacity to the climate, increase in hose capacity and easy equipment replacement. The improved liquid heater of the instant invention can deliver from 125,000 BTU to 360,000 BTU depending on climate and field conditions, and operates on a 120 volt system. Due in part to the more efficient layout, the lower voltage system and the reduced pumping requirements, the pump of the instant invention is powered by a 120 volt, 1 horsepower motor. The power can be supplied from a conventional outlet by use of a heavy duty extension cord. This improvement allows the user to maintain the same GPM as the previous apparatus while eliminating the need for a 230 volt electric system and thereby lowering operating costs.

With the improvement to the voltage system, the electric control box in the instant invention has also been improved by using a motor starter for the 1 horsepower pump and a fused circuit for the blower motor on the boiler. A Ground Fault Interrupter (GFI) circuit outlet for the lights and air compressor is also provided along with start and stop switches for the pump and boiler. The advantage of this is not only to make the device easier to use but to meet the NESC requirements.

Additionally, the number of reels in the instant invention have been decreased from the two used in my previous invention to one, while increasing the reel's size. A single reel provides more available space in the trailer and lowers operation costs. In light of the system's size increase, the diesel fuel tank has also been increased to 60 gallons, which allows for longer periods between fueling. Thus, allowing the system to run longer. The trailer is configured so that the diesel fuel tank and auxiliary generator gasoline tank are re-positioned outside the trailer. This increases the safety of the unit and allows for the device to be refueled without the necessity of shutting down the system.

The improved device of the instant invention is broadly a mobile atmospheric hot liquid boiler apparatus with a number of uses. In one configuration, the instant invention can supply hot water for use in, for example, a variety of field or other remote situations for purposes of personal hygiene, facility cleanup, or mobile kitchens, such as for use in a Forest Service camp site.

In a second configuration, the liquid circulating through a conduit can provide heated liquid to a heat exchanger or other radiation-type device, which, either alone or in combination with some forced-air device, may be used to provide, among other uses, interior space heating for remote locations or emergency facilities, heat to surfaces such as floors or the ground for water drainage, and the like.

In another configuration, the device can be used to thaw the ground for water drainage, excavation, trenching, digging foundations, working on roadways, heating asphalt for installation or curing concrete in cold weather. The device may also be used to heat fluids in storage tanks, frozen water, pipelines, holding ponds, and swimming pools. The device melts ice or heating spilled products on frozen terrain in almost any location.

In yet another configuration, the device can be used to heat and dry wet ground or travel-ways, thereby eliminating the need to transport fill dirt or soils to other locations, which tends to compound the many problems associated with road construction and results in slow-downs and construction delays.

In another aspect of the invention, a biodegradable, freezing-point depression solution is used to prevent the liquid conduits from freezing when the device is idle. The biodegradable nature of the solution avoids possible contamination of the liquid, the liquid boiler, the hoses, the reservoir, or the environment in the event of a line break or spill.

The improved device can be towed by a regular vehicle or mounted on skids and dragged by heavy equipment. The improved device can operate with parts from local hardware stores and only requires at most two people to operate. The device can work in four different directions and allows for eight hoses to heat an area. The hoses can also be spliced in order to incorporate additional equipment and can operate even when some of the hoses have been shut down.

Other objects, features, and advantages of the present invention will become apparent to those skilled in the art from the following detailed description. It should be understood, however, that the detailed description and specific examples, while indicating preferred embodiments of the present invention, are given for purposes of illustration and not of limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more fully understood from the detailed description to follow, with reference being made to the accompanying drawings in which like reference numerals represent like parts throughout and in which.

DETAILED DESCRIPTION OF THE DRAWINGS

Figure 1:
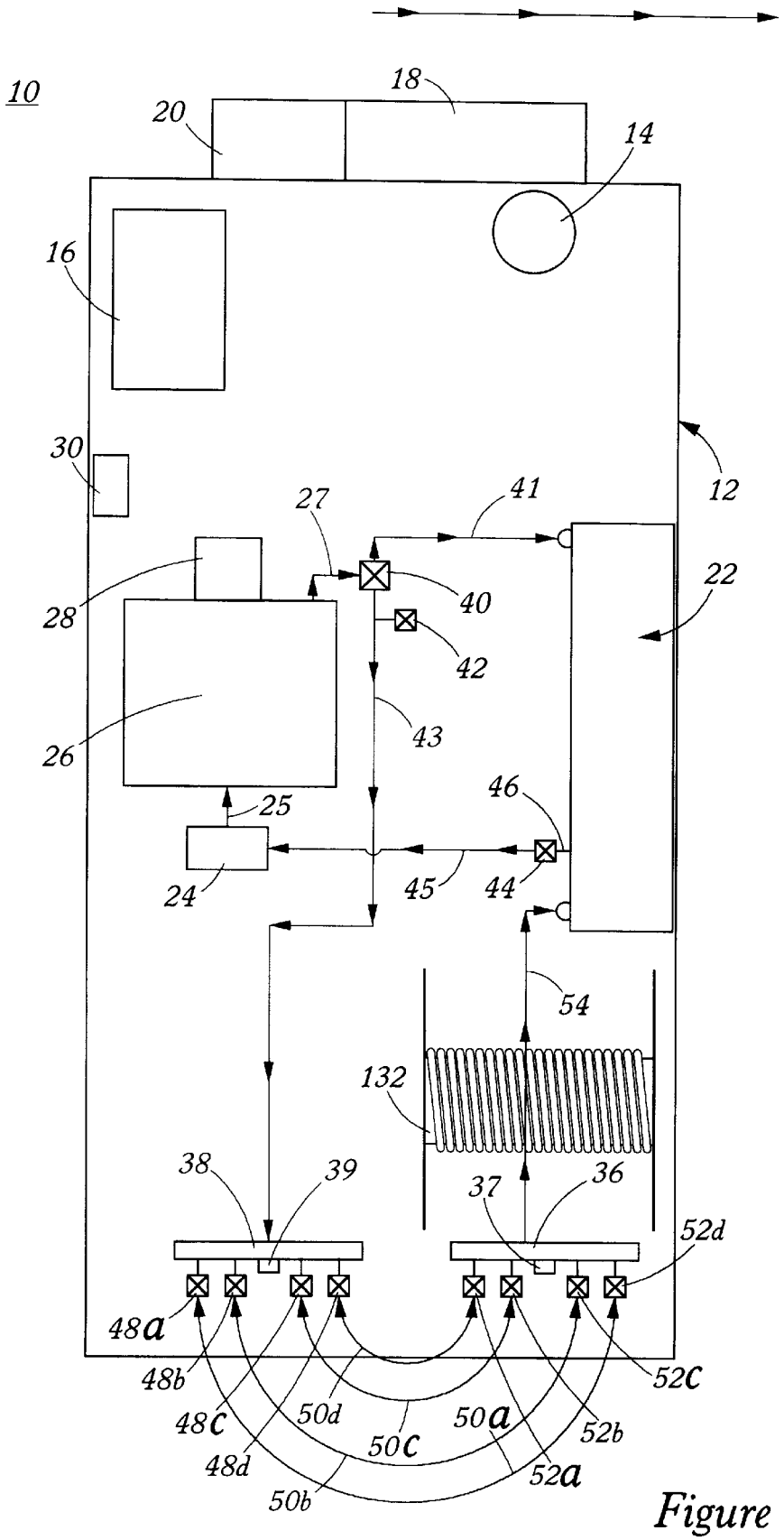
FIG. 1 is an illustrative top view of the layout of the device in accordance with a preferred embodiment of the instant invention.

Turning to the drawings, where like numbers designate like apparatus or elements, there is shown in FIG. 1 an improved mobile atmospheric heater system 10. The system 10 is situated on a trailer 12. An improved trailer 12 configuration, fewer hose requirements, and an increase in the system's size better allow for further expansion of the system 10. The use of larger hoses and boilers allows increased capacity of the liquid reservoir to 110 gallons, which further allows more liquid to flow through the system and thereby facilitates accommodation of larger job sites.

In accordance with the invention depicted in FIG. 1, mounted upon trailer 12 is an air compressor 14, a generator 16, a liquid reservoir 22, a liquid pump 24, a boiler 26, a burner 28, an electrical panel 30, hose reel 32, a return manifold 36, an exit manifold 38, exit valves 48*a–d*, hoses 50*a–d*, return valves 52*a–d*, a dual positioned bypass valved shunt 40, an air intake valve 42, a reservoir valve 44, and conduits 25, 27, 39, 41, 43, 45, 46 and 54. In accordance with the system 10 of the instant invention, liquid pump 24 communicates with boiler 26 via conduit 25. The boiler 26 is in further communication with a dual positioned bypass valved shunt 40 via conduit 27. A dual positioned bypass valved shunt 40 communicates via conduit 41 with a liquid reservoir 22 and, alternately, via conduit 43 with an exit manifold 38. An exit manifold 38 communicates with exit valves 48*a–d*, which communicate with return valves 52*a–d* via hoses 50*a–d*. Return valves 52*a–d* are in further communication with return manifold 36. Return manifold 36 communicates via conduit 54 with liquid reservoir 22. An air intake valve 42 communicates with conduit 43. A liquid reservoir 22 communicates via conduit 46 with a reservoir valve 44, which is in further communication with liquid pump 24 via conduit 45. A diesel fuel tank 18 which fuels boiler 26 and a gasoline tank 20 which fuels generator 16 are located on the exterior perimeter of the trailer 12. The communication of the above described components and the liquid flow of the present invention will be better understood by the description of FIGS. 2 and 3 to follow.

Figure 2:
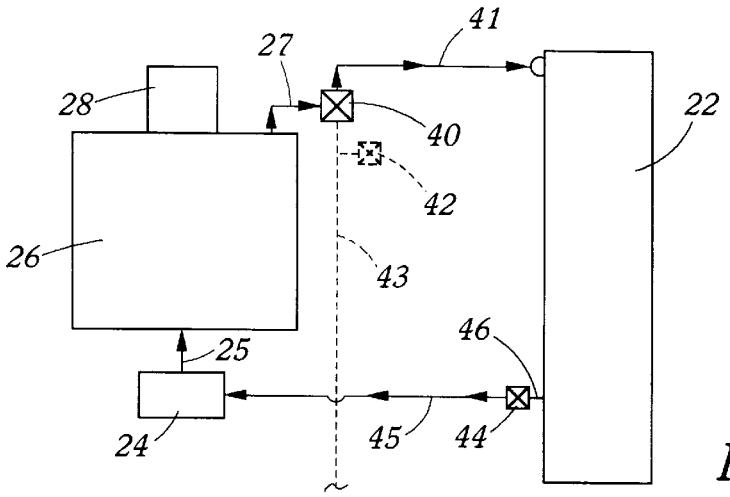
FIG. 2 is an operating schematic of the warm up phase of the system of FIG. 1.

Turning to FIG. 2, there is shown an isolation schematic of the warm-up bypass loop, as shown in FIG. 1, in accordance with the preferred embodiment of the instant invention. As shown in FIG. 2, when the system is in warm-up and/or idle-stand-by mode, the dual positioned bypass valved shunt 40 is in a first position such that the flow is from the liquid reservoir 22, through the exit connection transfer conduit 46, through the reservoir valve 44 to the liquid pump 24 via conduit 45. The liquid is circulated through the pump 24 into the boiler 26 via conduit 25. Thus, the boiler 26 heats the liquid which exits the boiler 26 through an exit conduit 27 and travels through the dual positioned bypass valved shunt 40 back into the liquid reservoir 22 via conduit 41. Therefore, a shunted recycle loop is formed between the boiler 16 and the reservoir 22 when dual positioned bypass valved shunt 40 is in the first position.

Figure 3:
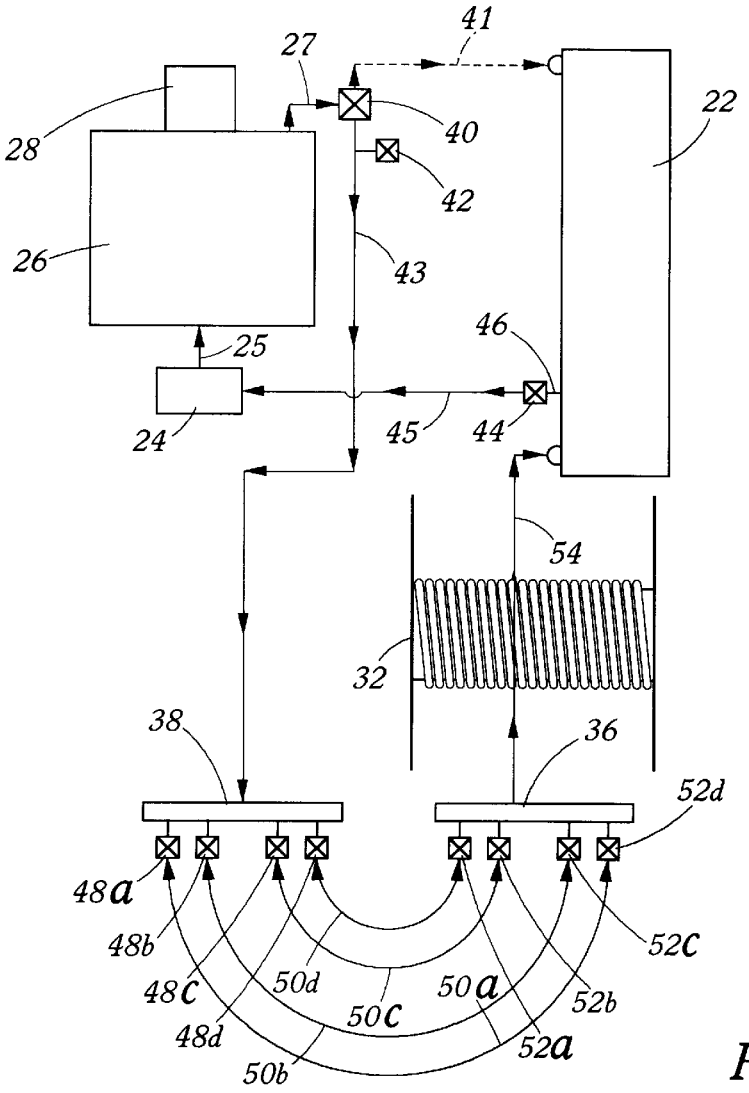
FIG. 3 is a flow chart of the system operation in accordance with the embodiment as set forth in FIG. 1.

Turning to FIG. 3, there is shown a flow diagram of the system operation in accordance with one preferred embodiment of the instant invention. When the system is in operation i.e. not in stand-by or warmup mode, the dual positioned bypass valved shunt 40 is moved to the second position. The passage through the conduit 41 (depicted by the doted line) is closed and the liquid passage through conduit 43 is opened. The heated liquid exits the boiler 26 through exit conduit 27, travels through the dual positioned bypass valved shunt 40 set to the second position, into the exit manifold 38 by means of conduit 43. The liquid flows through the exit valves 48*a–d* into hoses 50*a–d*. The liquid reenters through return valves 52*a–d* and travels through the return manifold 36. The liquid returns to the liquid reservoir 22 by means of conduit 54. The returned liquid then flows from the liquid reservoir 22 through the exit connection transfer conduit 46, through the reservoir valve 44 to the liquid pump 24 by means of conduit 45. The liquid is pumped by means of the liquid pump 24 into the boiler 26 via the conduit 25 which communicates with boiler 26. The liquid is again heated in boiler 26 to repeat the above described process.

Hose Reel 32 stores the hoses 50*a–d* in sequence. Thus, one reel stores all the hosing on the unit. The first section of hose 50*a* is played onto the reel 32. The end of hose 50*a* is connected to one end of the next section of hose 50*b* which is in turn played onto the reel 32 and so on in a continuous manner until all the sections are played onto the reel. The reel retains the hose when not in use or when being transported. Generator 16 is an optional, and required for unit operation when no other source of electricity is available. The Air Compressor 14 is to provide the air to dewater or blow drain the system and to mobilize the pigging device. Electric Panel 30 contains control switches to operate the system components, such as on-off switches for the Pump and the Boiler as well as circuit breakers. Burner 28 is a part of the Boiler containing the burner head, the blower, and the fuel pump (not shown). Tank 18 contains diesel fuel for the boiler and communicates (not shown) with the burner 28. Tank 20 contains gasoline for the generator 16.

Figure 4:
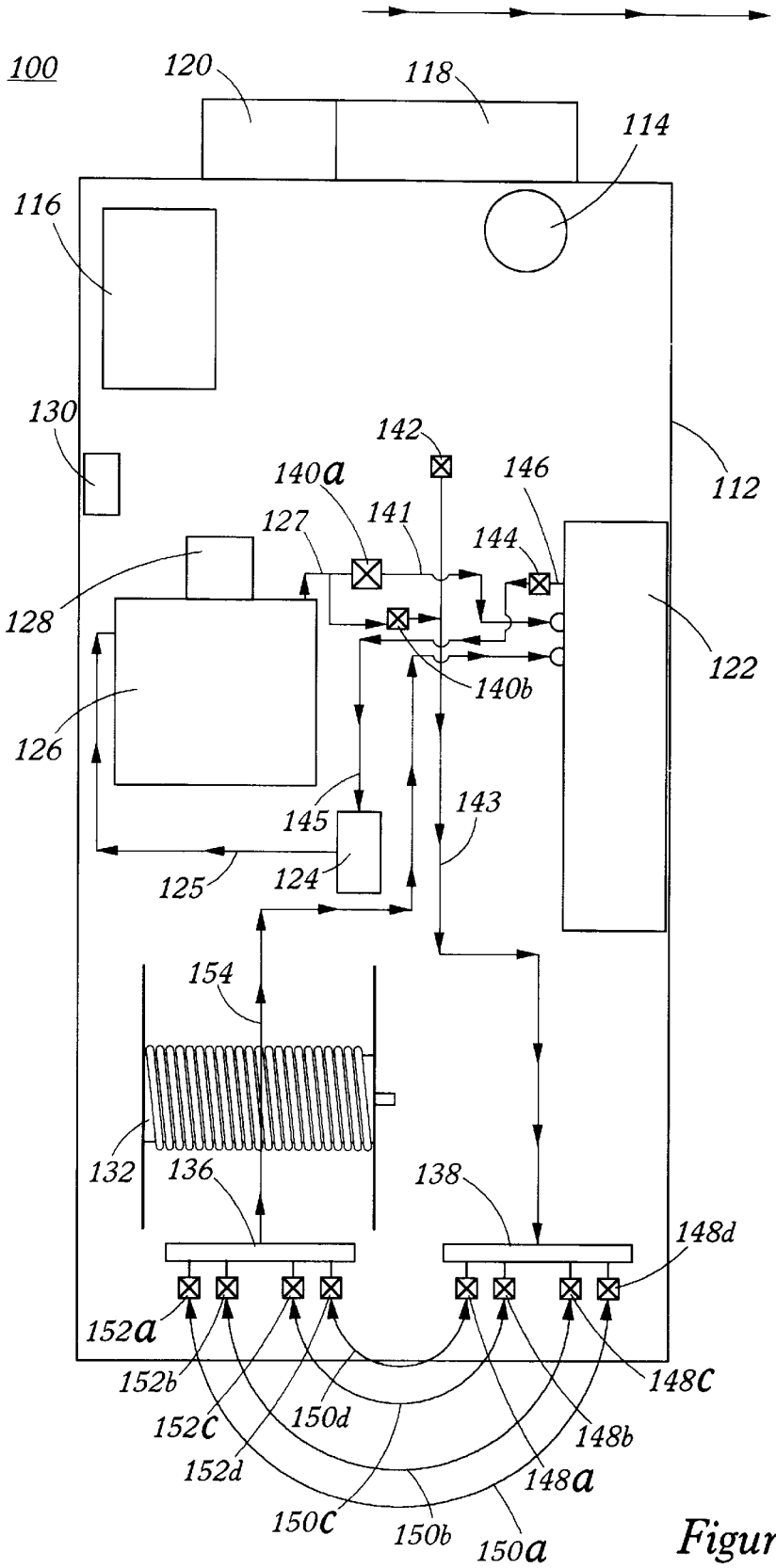
FIG. 4 is an illustrative top view of the layout of the device in accordance with another embodiment of the instant invention.

Turning to FIG. 4, there is shown an illustrative top view of the layout of the device in accordance with a second embodiment of the instant invention. There is shown the device 100 situated on a trailer 112 and having components in spaced apart relationship as follows: trailer 112 containing an air compressor 114, generator 116, a liquid reservoir 122, a liquid pump 124, a boiler 126, a burner 128, an electrical panel 130, hose reel 132, a return manifold 136, an exit manifold 138, exit valves 148*a–d*, hoses 150*a–d*, return valves 152*a–d*, a single positioned bypass valved shunt 140, an air intake valve 142, a reservoir valve 144, and conduits 125,127, 141, 143, 145, 146 and 154. Diesel fuel tank 118 and a gasoline tank 120 are located on the exterior perimeter of trailer 112.

In accordance with the device 100 of the instant invention, liquid pump 124 communicates with boiler 126 via conduit 125. The boiler 126 is in further communication with a single positioned bypass valved shunt 140*a* via conduit 127. A single positioned bypass valved shunt 140*a* communicates via conduit 141 with a liquid reservoir 122 and, alternately, via conduit 143 with an exit manifold 138. An exit manifold 138 communicates with exit valves 148*a–d*, which communicate with return valves 152*a–d* via hoses 150*a–d*. Return valves 152*a–d* are in further communication with return manifold 136. Return manifold 136 communicates via conduit 154 with liquid reservoir 122. An air intake valve 142 communicates with conduit 143. Liquid reservoir 122 communicates via conduit 146 with a reservoir valve 144, which is in further communication with liquid pump 124 via conduit 145.

Figure 5:
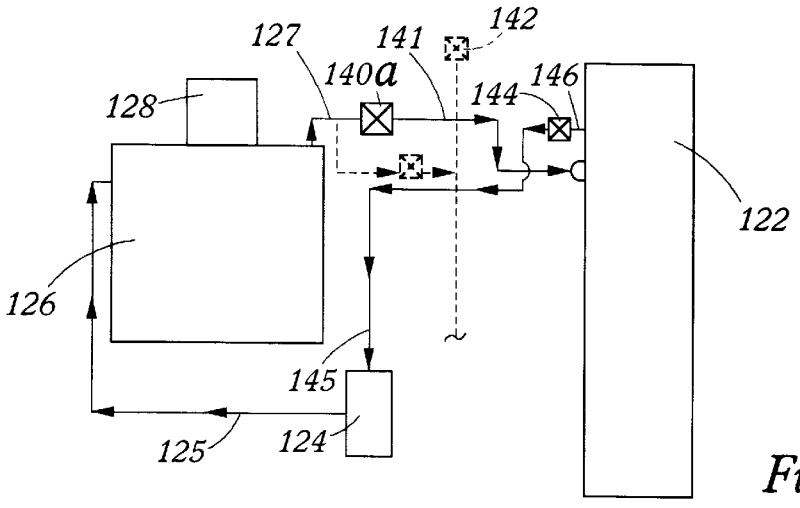
FIG. 5 is an operating schematic of the warm up phase of the system of FIG. 4.

Turning to FIG. 5, there is shown an operating schematic of the warm up phase of the preferred embodiment set forth in FIG. 4. When the system is in warm-up bypass mode, the single positioned bypass valved shunt 140*a* is opened and valve 140*b* is closed. The liquid flows from the liquid reservoir 122 through the exit connection transfer conduit 146, through the reservoir valve 144 and into the liquid pump 124 via conduit 145. The liquid is then pumped by liquid pump 124 through conduit 125 and enters the boiler 126. Within boiler 126 the liquid is heated and exits the boiler 126 travels through an exit conduit 127 enters the opened single positioned bypass valved shunt 140*a* and returns to the liquid reservoir 122 via conduit 141.

Figure 6:
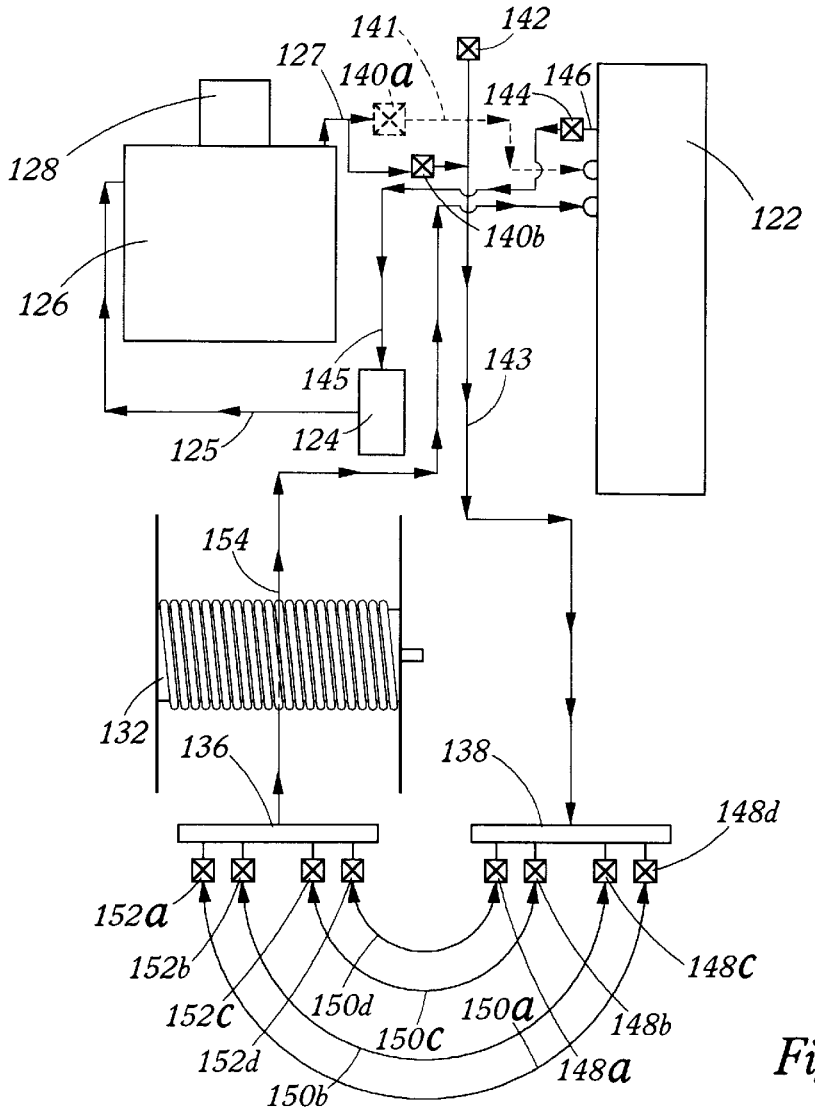
FIG. 6 is a flow chart of the system operation in accordance with the embodiment in FIG. 4.

Turning to FIG. 6, there is shown an operating schematic of the system shown in FIG. 4 in operation. When the system is in operation, the single positioned bypass valved shunt 140*a* is turned to the off position and valve 140*b* is opened. The heated liquid exits the boiler 126 through an exit conduit 127, enters the valve 140*b*, exits through conduit 143 and enters the exit manifold 138. The liquid then passes through valves 148*a–d* into hoses 150*a–d* where it is circulated and reenters through return valves 152*a–d*. The liquid then flows through the return manifold 136 back into the liquid reservoir 122 via conduit 154. The returned liquid then flows from the liquid reservoir 122, through the exit connection transfer conduit 146, through the reservoir valve 144 and into the liquid pump 124, via conduit 145. The liquid is then pumped by the liquid pump 124 into boiler 126 via conduit 125. Boiler 126 heats the liquid again. Air may be forced into the system through an intake valve 142 to expel any liquid during shut down and/or to deliquify the system.

Bypass Valved Shunt

As shown in FIG. 2, a dual positioned bypass valved shunt 40 is connected from the liquid boiler 26 directly to the liquid reservoir 22 for circulating liquid heated by the liquid boiler 26 to the liquid reservoir 22. In this manner, the liquid can be preheated and/or maintenance can be performed on the hoses without shutting down operation of the entire unit 10. Additionally, the unit 10 can be idled while hoses are moved, new hoses attached to the manifolds 38 and 36, and the like, while maintaining the temperature of the heated liquid.

To preheat the liquid, the dual positioned bypass valved shunt 40 is turned to first position and the fluid is directed from the liquid reservoir 22, through the pump 24 and into the boiler 26. The liquid then exits the boiler 26 and returns directly to the liquid reservoir 22 by means of the dual positioned bypass valved shunt 40. The liquid then flows from the liquid reservoir 22, into the pump 24 and back into the boiler 26 for the completion of the cycle, resulting in a much faster warm-up period. Thereafter, the dual positioned bypass valved shunt 40 is turned to the second operating position. In accordance with another embodiment, shown in FIGS. 4, 5, and 6, the single bypass valved shunt 40 is replaced with two single action valves 140*a* and140*b*. Other configurations to effect this warm up cycle are possible and can be readily ascertained by the skilled artisan upon reading this specification.

Liquid Reservoir

The liquid reservoir 22 has a 2-inch inlet (filling port) for filling (not shown), which has a T-handle and holes drilled in the top of the cap to allow escape of pressure in the form of steam. This cap can also be removed during operation to allow steam to escape, thereby preventing pressure buildup. The reservoir 22 also has a 1¼ inch inlet for the return of liquid from the return manifold. A sight gauge is preferably located on the front side of the reservoir 22, facing the liquid boiler 26, to show fluid level (not shown). For example, each inch on the sight gauge corresponds to 2½ gallons of liquid in liquid reservoir 22, which in the preferred embodiment has a 110 gallon capacity. In the alternate embodiment, the liquid reservoir 22 has a 90 gallon capacity.

Liquid Pump

The liquid pump 24 is positioned between the liquid reservoir 22 and the liquid boiler 26. The pump 24 is connected to the liquid boiler 26. The pump 24 preferably has a 1 horsepower, 120 volt electric motor without reducing pumping capacity.

The High Heat Capacity Liquid Boiler

The liquid boiler 26 of the instant invention is a high heat capacity unit. The fuel used therein is diesel type #2, diesel type #1, or heating oil #1. The liquid boiler 26 uses 1½ to 2½ gallons of fuel per hour while operating on diesel fuel. The steel diesel fuel tank 18 has a 60 gallon capacity. The tank also has a sight gauge (not shown) on the side with each inch representing 2½ gallons of fuel.

Exit and Return Manifolds

A 1¼ inch conduit 43 communicates with the dual positioned bypass valved shunt 40 and the in-line air valve 42 and continues to the exit manifold 38, which houses valves 48*a–d* which connect to the hoses 50*a–d*. The 3-inch steel manifolds 36 and 38 are 24 inches in length and each has four, ¾ inch connections, 52*a–d*and 48*a–d*, respectively, and a plugged 1¼ inch connection, 39 and 37, respectively. This plugged 1¼ inch connection on each of the manifolds 36 and 38 allows for use of a test hose for testing the liquid heater without necessitating the connection of a minimum of 500 feet of hose, and, further, this 1¼ inch connection allows the use of a single hose of this diameter, rather than a plurality of smaller dimensioned hoses.

The exit and return manifolds 38 and 36, respectively, are mirror images of each other. Each of the four, ¾ inch connections, 48*a–d* and 52*a–d* at the manifolds 38 and 36, respectively, has a ball valve and is color-coded for purposes of identifying which hose 50*a–d*, also color coded, is being connected. Each color-coded hose 50*a–d* has a matching color-coded connector on manifolds 38 and 36, and each hose 50*a–d* can fit either hose to hose or to the connections 48*a–d* and 52*a–d* on manifolds 38 and 36, respectively. Operationally, all hoses 50*a–d* are compatible and therefore fit all connectors, regardless of color-coding. Color-coded hose and connector ends facilitate the pigging process as well as maintenance and drainage of the hose system. The same-colored end connectors of the hose readily identify which line is to have the pigging device catcher installed. Once the liquid flows through the manifolds 38 and 36, the liquid is returned to the reservoir 22 by means of a 1¼ inch conduit 54.

The Hoses

The device 10 is designed to provide 4 different hoses 50*a–d* having an outside diameter of 1.10 inches. The hose reel 32 has a capacity of 3000 feet of hose having a hose size of 0.75 inches ID, 1.100 inches OD and having a liquid capacity of 1 gallon per 43 feet, 11.6 gallon per 500 feet with a maximum 150 PSI, 250 degrees Fahrenheit, and 500 or 750 feet per lateral (4 laterals×500=2,000 feet total length; or 4 laterals×750=3,000 feet total length). The hoses are color coded to facilitate the location of a particular hose. When not in use, the hoses are emptied of all liquid solution.

To set up the device 10 in a particular location, the color-coded valves 48*a–d* and 52*a–d* on manifolds 38 and 36, respectively, are closed. A first, or top, hose is then pulled from the hose reel 32, and a first end of the hose is connected to one of the valves 48*a–d* on manifold 38 with the second end of the hose still on reel 32. When the second end of the hose exits the hose reel 32, it is connected to the correspondingly colored valve 52*a–d* on the return manifold 36, and the process is started again with another hose on the hose reel 32 until all four hoses have been taken off the reel 32 and have been connected to the valves 48*a–d* and 52*a–d* on manifolds 38 and 36, respectively, according to their respective color coding. To obtain the most efficient performance, all hoses and valves on the manifolds 38 and 36 should be used. The hoses are returned to the hose reels 32 by performing the above procedure in reverse order.

The Liquid

The system uses a biodegradable, freezing-point depression solution for freeze protection. The biodegradable nature of the solution avoids contamination of the liquid boiler, the hoses, and the reservoir and prevents extra cleanup in the event of a line break or spill.

Electrical System

The electrical system has a 5000 watt gasoline-powered generator 16 for use in remote areas without available electricity. Operating under maximum load, the fuel capacity of the generator 16 is limited to 9½ hours. The system can be connected only to a single electric source at a time, which can be either the generator 16 or the utility company. An 11 gallon gasoline tank 20 is installed on the exterior perimeter of the trailer 12 in communication with the generator 16.

The 120 volt equipment used in the electrical system of the improved liquid heater includes a 1 HP liquid pump 24. The system also supports a 5 HP, 20 gallon air compressor 14, and a 110 volt electric system to the boiler 26.

In Operation

The procedure for operation of the system comprises the following: The warm up bypass phase is initiated by first turning the dual positioned bypass valved shunt 40 to a first position and opening reservoir valve 44. The pump 24 and boiler 26 are turned on, and the boiler is set to 165 to 200 degrees Fahrenheit. The liquid then flows from the reservoir 22 through conduit 46 and reservoir valve 44 to the pump 24 by means of conduit 45. The liquid then flows from the pump 24 into the boiler 26 by means of conduit 25. The liquid is heated by boiler 26 and then released through conduit 27. The liquid travels through dual positioned bypass valved shunt 40 and back to the liquid reservoir 22 via conduit 41. This process takes approximately 20 minutes.

The color-coded hoses 50*a–d* are connected to the color-coded valves 48*a–d* and 52*a–d* on manifolds 38 and 36, respectively, during the above-described warm-up phase. The dual positioned bypass valved shunt 40 is turned to a second position, and then valves 48*a–d* and 52*a–d* are opened. In full system operation, in contrast to warm-up bypass, the liquid heated during the warm-up phase moves from the liquid reservoir 22 through conduit 46 and through reservoir valve 44 to pump 24 by means of conduit 45. Reservoir valve 44 is used to contain fluid within the reservoir 22 when the unit is not in operation and can be used, if necessary, to control pump pressure to boiler 26 by constricting fluid flow from reservoir 22 to pump 24. The liquid then flows through the pump 24 back to the boiler 26 by means of conduit 25. The boiler 26 heats the liquid again. The liquid then flows through conduit 27 through dual positioned bypass valved shunt 40 to the exit manifold 38 by means of conduit 43. The liquid then flows through the opened valve(s) 48*a–d* through the color coded hose(s) 50*a–d*, connected to the opened valve(s) 48*a–d*, into opened valves 52*a–d* on the return manifold 36. The liquid then returns to the reservoir 22 from the return manifold 36 by means of conduit 54. This process takes approximately 4 minutes. After operating for 30–40 minutes, all liquid returning to the reservoir 22 will have achieved a high enough temperature that the liquid boiler 26 will begin auto shut down and will maintain system liquid at the designated thermostat setting on the thermostat (not shown) of the boiler 26. After approximately 20–30 minutes of operation, the liquid returning to the liquid reservoir 22 will be within 8 to 10 degrees of the liquid exiting liquid boiler 26 and within an hour will be within 5 degrees of the liquid exiting the boiler 26.

The Dual Pigging System

To empty a hose, the pump 24 and liquid boiler 26 are shut off, and the dual positioned bypass valved shunt 40 is closed. Air compressor 14 is started, and the pressure is built up to 120 PSI. An air hose is connected to air compressor 14 and in-line air valve 42. The in-line air valve 42 is opened. After 10 seconds, the air valve 42 is closed, as are all valves 48*a–d* and 52*a–d* on manifolds 38 and 36, respectively. A first colored hose 50*a–d* is disconnected from both manifolds 38 and 36. A pigging device (not shown) is inserted into this first hose 50*a–d*. One launching/receiving pigging catcher (not shown) is inserted at the correspondingly colored valve 52*a–d*, and one launching/receiving pigging catcher is inserted at the correspondingly colored valve 48*a–d*. The hose 50*a–d* is reconnected to the appropriate valves 48*a–d* and 52*a–d* at the respective manifolds 38 and 36. Only the appropriate valves 48*a–d* and 52*a–d* attached to the hose to be cleaned and air valve 42 are opened. Air valve 42 communicates with air compressor 14 via an air hose (not shown). Air from air compressor 14 is allowed to flow through air valve 42 for two to three minutes in order to allow the air to push any liquid out of the hose 50*a–d* and into the reservoir 22. The air compressor 14 is then shut off, and the respective valves 48*a–d* and 52*a–d* closed. The launching/receiving pigging device catcher set to receive the pigging device is checked. If for any reason the pigging device is not in the launching/receiving pigging catcher set to receive the pigging device, the hose 50*a–d* is checked for kinks or squeezing, and the process is then repeated. Once the pigging device has reached the launching/receiving pigging device catcher set to receive the pigging device, the remaining hoses 50*a–d* are cleared using the same process. However, the launching/receiving pigging device set previously to catch the pigging device is used to launch the pigging device, and the launching/receiving pigging device set previously to launch the pigging device is used to catch the pigging device, thereby preventing the user from having to remove the pigging device and handle a wet pigging device.

When the unit 10 is not in operation, the valves 48*a–d* and 52*a–d* located at the manifolds 38 and 36, respectively should be closed. The hoses 52*a–d* are rolled up one at a time onto hose reel 32 for storage and transport.

Although the present invention has been described with reference to preferred embodiments, numerous modifications and variations can be made and the result still will come within the scope of the invention. No limitation with respect to the specific embodiments disclosed herein is intended or should be inferred.

What is claimed is:

1. Mobile atmospheric unit for providing a heated liquid, comprising:

a) a liquid boiler means for generating a heated liquid;

b) a pump means for providing a circulating pressure;

c) a multiple conduit exit manifold communicating with said liquid boiler by way of said pump means for dispensing said heated liquid;

d) a multiple conduit return manifold, communicating with at least one conduit, for return of said heated liquid;

e) at least one conduit, communicating with said exit manifold and said return manifold, for circulating said heated liquid;

f) a reservoir, communicating with said return manifold and said liquid boiler for containing the returned heated liquid and feeding said returned heated liquid to said liquid boiler; and, g) a valved shunt means, communicating with said liquid boiler and the reservoir for circulating said heated liquid generated in said liquid boiler and, alternatively to said reservoir or to said exit manifold.

2. The mobile atmospheric unit of claim 1 wherein said valved shunt means is a dual check valve for circulating said heated liquid generated in said liquid boiler to said reservoir or to said exit manifold.

3. The mobile atmospheric unit of claim 1 wherein said valved shunt means is a two valve arrangement for circulating said heated liquid generated in said liquid boiler to said reservoir or to said exit manifold.

4. The mobile atmospheric unit of claim 1 wherein a biodegradable freezing point depressant is admixed with said heated to retard the freezing point of said liquid.

5. The mobile atmospheric unit of claim 1 wherein said at least one conduit may be independently shut down by means of a valve arrangement.

6. The mobile atmospheric unit of claim 1 wherein said at least one conduit is flexible for facilitating transport and storage of said mobile atmospheric unit.

7. The mobile atmospheric unit of claim 1 wherein said at least one conduit communicates with at least one heat exchanger for radiating heat into the surrounding air space.

8. The mobile atmospheric unit of claim 7 further comprising means for forcing air to enhance a radiated heat effect of said at least one heat exchanger.

9. The mobile atmospheric unit of claim 1 wherein said at least one conduit communicates by convection with a surrounding ground space to affect heating and drying thereof.

10. The mobile atmospheric unit of claim 1 operating by means of a 120 volt electrical system.

11. The mobile atmospheric unit of claim 1 wherein said pump has a 1 horsepower motor.

12. The mobile atmospheric unit of claim 1 wherein said liquid reservoir has a 110 gallon capacity.

13. The mobile atmospheric unit of claim 1 wherein said atmospheric unit is mounted to a trailer for the purpose of mobility.

14. The mobile atmospheric unit of claim 1 wherein said atmospheric unit is mounted on skids.

15. The mobile atmospheric unit of claim 1 further comprising a 60 gallon diesel fuel tank.

16. The mobile atmospheric unit of claim 1 further comprising an 11 gallon auxiliary generator gasoline tank.

17. The mobile atmospheric unit of claim 1 wherein said at least one conduit is color coded.

18. The mobile atmospheric unit of claim 1 wherein said heated liquid is water.

19. A mobile atmospheric unit for providing a heated liquid, comprising:

a liquid boiler means for generating a quantity of a heated liquid effective for radiating heat from a flexible conduit;

a multiple conduit exit manifold communicating with said liquid boiler for dispensing said heated liquid;

a pump means for moving said heated liquid from said liquid boiler to said exit manifold;

at least one conduit, communicating with said exit manifold, for circulating said heated liquid;

a return manifold, communicating with said at least one conduit, for return of said heated liquid to a reservoir;

a reservoir, communicating with said return manifold and said liquid boiler for containing the returned heated liquid and incrementally feeding said returned heated liquid to said boiler; and, a valved shunt means, communicating with said liquid boiler and said reservoir for circulating said heated liquid generated in said liquid boiler to said reservoir.

20. The mobile atmospheric unit of claim 19 wherein said valved shunt means is a dual check valve for circulating said heated liquid generated in said liquid boiler to said reservoir and to said exit manifold.

21. The mobile atmospheric unit of claim 19 wherein said valved shunt means is a two valve arrangement for circulating said heated liquid generated in said liquid boiler to said reservoir and said exit manifold.

22. The mobile atmospheric unit of claim 19 wherein a biodegradable freezing point depressant is admixed with said heated liquid to retard the freezing point of said liquid.

23. The mobile atmospheric unit of claim 19 wherein said at least one conduit may be independently shut down by means of a valve arrangement.

24. The mobile atmospheric unit of claim 19 wherein said at least one conduit is flexible for facilitating transport and storage of said mobile atmospheric unit.

25. The mobile atmospheric unit of claim 19 wherein said at least one conduit communicates with at least one heat exchanger for radiating heat into a surrounding air space.

26. The mobile atmospheric unit of claim 25 further comprising means for forcing air to enhance a radiated heat effect of said at least one heat exchanger.

27. The mobile atmospheric unit of claim 19 wherein said at least one conduit communicates by convection with a surrounding ground space to affect heating and drying thereof.

28. The mobile atmospheric unit of claim 19 operating by means of a 120 volt electrical system.

29. The mobile atmospheric unit of claim 19 wherein said pump has a 1 horsepower motor.

30. The mobile atmospheric unit of claim 19 wherein said liquid reservoir has a 110 gallon holding capacity.

31. The mobile atmospheric unit of claim 19 wherein said atmospheric unit is mounted to a trailer for the purpose of mobility.

32. The mobile atmospheric unit of claim 19 wherein said atmospheric unit is mounted on skids.

33. The mobile atmospheric unit of claim 19 further comprising a 60 gallon diesel fuel tank.

34. The mobile atmospheric unit of claim 19 further comprising an 11 gallon auxiliary generator gasoline tank.

35. The mobile atmospheric unit of claim 19 wherein said at least one conduit is color coded.

36. The mobile atmospheric unit of claim 19 wherein an air compressor communicates with said at least one conduit for discharging said liquid from said at least one conduit.

37. The mobile atmospheric unit of claim 19 wherein said heated liquid is water.

38. The mobile atmospheric unit of claim 19 wherein said reservoir and said liquid boiler are a booster recirculating type system for providing fast recovery and large heat capacity for incrementally super-heating said heated liquid before returning it to said multiple conduit exit manifold.

39. The mobile atmospheric unit of claim 19 wherein at least one radiator type heat exchanger is spliced into said at least one conduit; and, at least one blower is used to distribute heat generated by said at least one heat exchanger.

40. A method for providing heated liquid comprising the steps of:

(a) heating a liquid in a liquid boiler;

(b) circulating said heated liquid to a liquid reservoir by means of a valved shunt wherein said valved shunt for circulating said heated liquid is selected from a group consisting of a dual check valve and a two valve arrangement;

(c) circulating said heated liquid from said reservoir back to said liquid boiler;

(d) circulating said heated liquid from said boiler to an exit manifold;

(e) circulating said heated liquid from said exit manifold to a return manifold by means of at least one conduit, (f) returning said heated liquid to said reservoir from said return manifold; and, introducing said returned liquid to said liquid heater to be reheated.

41. The method of claim 40 wherein a biodegradable freezing point depressant is admixed with said heated liquid to retard the freezing point of said liquid.

42. The method of claim 40 wherein said at least one conduit may be independently shut down by means of a valve arrangement.

43. The method of claim 40 wherein said at least one conduit is flexible for facilitating transport and storage of said mobile atmospheric unit.

44. The method of claim 40 wherein said at least one conduit communicates with at least one heat exchanger for radiating heat into a surrounding air space.

45. The method of claim 40 further comprising a means for forcing air to enhance a radiated heat effect of said at least one heat exchanger.

46. The method of claim 40 wherein said at least one conduit communicates by convection with a surrounding ground space to affect heating and drying thereof.

47. The method of claim 40 wherein a mobile atmospheric unit is powered by means of a 120 volt electrical system.

48. The method of claim 40 wherein a pump has a 1 horsepower motor.

49. The method of claim 40 wherein a liquid reservoir has a 110 gallon holding capacity.

50. The method of claim 40 wherein said atmospheric unit is mounted to a trailer for the purpose of mobility.

51. The method of claim 50 wherein said atmospheric unit is mounted on skids.

52. The method of claim 40 wherein said atmospheric unit further comprises a 60 gallon diesel fuel tank.

53. The method of claim 40 wherein said atmospheric unit further comprises an 11 gallon auxiliary generator gasoline tank.

54. The method of claim 40 wherein said at least one conduit is color coded.

55. The method of claim 40 wherein an air compressor communicates with said at least one conduit for discharging said liquid from said at least one conduit.

56. The method of claim 40 wherein said heated liquid is water.

* * * * *